US007540296B2

(12) United States Patent
Meyers et al.

(10) Patent No.: US 7,540,296 B2
(45) Date of Patent: Jun. 2, 2009

(54) COMFORT CANE

(75) Inventors: Daniel Seth Meyers, Roxboro (CA); Cristian Boar, Montreal (CA)

(73) Assignee: AMG Medical Inc., Montreal, Quebec (CA)

( * ) Notice: Subject to any disclaimer, the term of this patent is extended or adjusted under 35 U.S.C. 154(b) by 163 days.

(21) Appl. No.: 11/434,788

(22) Filed: May 17, 2006

(65) Prior Publication Data

US 2007/0267053 A1 Nov. 22, 2007

(51) Int. Cl.
*A45B 9/02* (2006.01)
*A45B 9/04* (2006.01)

(52) U.S. Cl. ..... 135/76; 135/77

(58) Field of Classification Search ..... 135/65, 135/75–78, 82; 16/421, 430; 74/551.9
See application file for complete search history.

(56) References Cited

U.S. PATENT DOCUMENTS

| | | | | |
|---|---|---|---|---|
| D187,842 | S | 5/1960 | Jeys | |
| 3,363,639 | A | 1/1968 | Kurpis | |
| 3,768,495 | A | 10/1973 | Smith | |
| D231,043 | S | 3/1974 | Barnett | |
| 3,995,650 | A | 12/1976 | DiVito | |
| 4,730,632 | A | 3/1988 | Mace | |
| 4,971,088 | A | 11/1990 | Lyng | |
| 5,356,237 | A | 10/1994 | Sung | |
| 5,482,070 | A | 1/1996 | Kelly | |
| 5,992,434 | A | 11/1999 | Berlin et al. | |
| 6,024,110 | A | 2/2000 | Renfro | |
| 6,131,593 | A | 10/2000 | Greeen et al. | |
| 6,802,482 | B2 * | 10/2004 | Harris | 248/188.9 |
| 6,877,520 | B2 | 4/2005 | Morris | |
| 6,964,382 | B2 * | 11/2005 | Alexander et al. | 239/526 |
| D514,307 | S | 2/2006 | Gillebaard | |
| 7,294,110 | B2 * | 11/2007 | Bourne et al. | 600/564 |
| 2003/0145881 | A1 * | 8/2003 | Harroun | 135/65 |
| 2004/0036194 | A1 | 2/2004 | Chadwick et al. | |
| 2004/0226593 | A1 * | 11/2004 | Robitaille et al. | 135/77 |

OTHER PUBLICATIONS

Search Report issued by the European Patent Office on corresponding EPO application EP08251559.2318 dated Jul. 7, 2008.231.

* cited by examiner

*Primary Examiner*—David Dunn
*Assistant Examiner*—Danielle Jackson
(74) *Attorney, Agent, or Firm*—Ogilvy Renault LLP

(57) ABSTRACT

A comfort cane includes a cane shaft having an upper end and lower end thereof, and a two-piece handle affixed to the upper end of the cane shaft. The handle includes a rigid body portion substantially defining a profile of the handle in a top view of the handle, and a top portion attached to the body portion. The top portion is soft and resilient with respect to the body portion.

14 Claims, 6 Drawing Sheets

COMFORT CANE

TECHNICAL FIELD

The present invention relates to canes, and more particularly to a cane having novel features for comfort and reliability thereof.

BACKGROUND OF THE INVENTION

Canes are well known in the prior art and are primarily used by elderly or disabled people. A conventional cane generally includes a cane shaft with a cane tip which may be made of resiliently deformable material attached to a lower end of the cane shaft, and a handle attached to an upper end of the cane shaft to provide a hand grip to a user. The hand grip is usually made of rigid material to enable the user to easily and securely grasp the handle. Elderly and disabled people may be somewhat unstable when walking and it is often difficult for them to securely grasp and hold onto a cane so it can be used in the intended fashion. In particular, a cane handle should meet the requirements of providing both a reliable hand grip which can be easily grasped and impact absorption when transferring loads. Those requirements however are not usually simultaneously met by conventional canes.

Therefore, it is desirable to provide canes with more reliability and comfortableness.

SUMMARY OF THE INVENTION

It is one object of the present invention to provide a cane which overcomes the shortcomings of conventional canes in terms of both reliability and comfortableness.

In accordance with one aspect of the present invention there is a cane provided which comprises a cane shaft having an upper end and a lower end thereof and a two-piece handle affixed to the upper end of the cane shaft. The handle includes a rigid body portion defining a low surface of the handle, and a top portion attached to the body portion. The top portion is soft and resilient with respect to the bottom portion.

The top and body portions of the handle in combination preferably comprise a hand grip having an upward projection extending from the top portion in a middle thereof.

The handle in a top view thereof preferably comprises an increasing width from a front section of the handle towards a rear end of the handle.

The top portion of the handle preferably comprises a surface having more frictional resistance than a surface of the body portion.

The cane preferably comprises a tip of soft and resilient material attached to the lower end of the cane shaft.

Advantages and other features of the present invention will be better understood with reference to the following description hereinafter.

BRIEF DESCRIPTION OF THE DRAWINGS

Reference will now be made to the accompanying drawings showing by way of illustration the preferred embodiments thereof, in which.

DETAILED DESCRIPTION OF THE PREFERRED EMBODIMENTS

Figure 1:
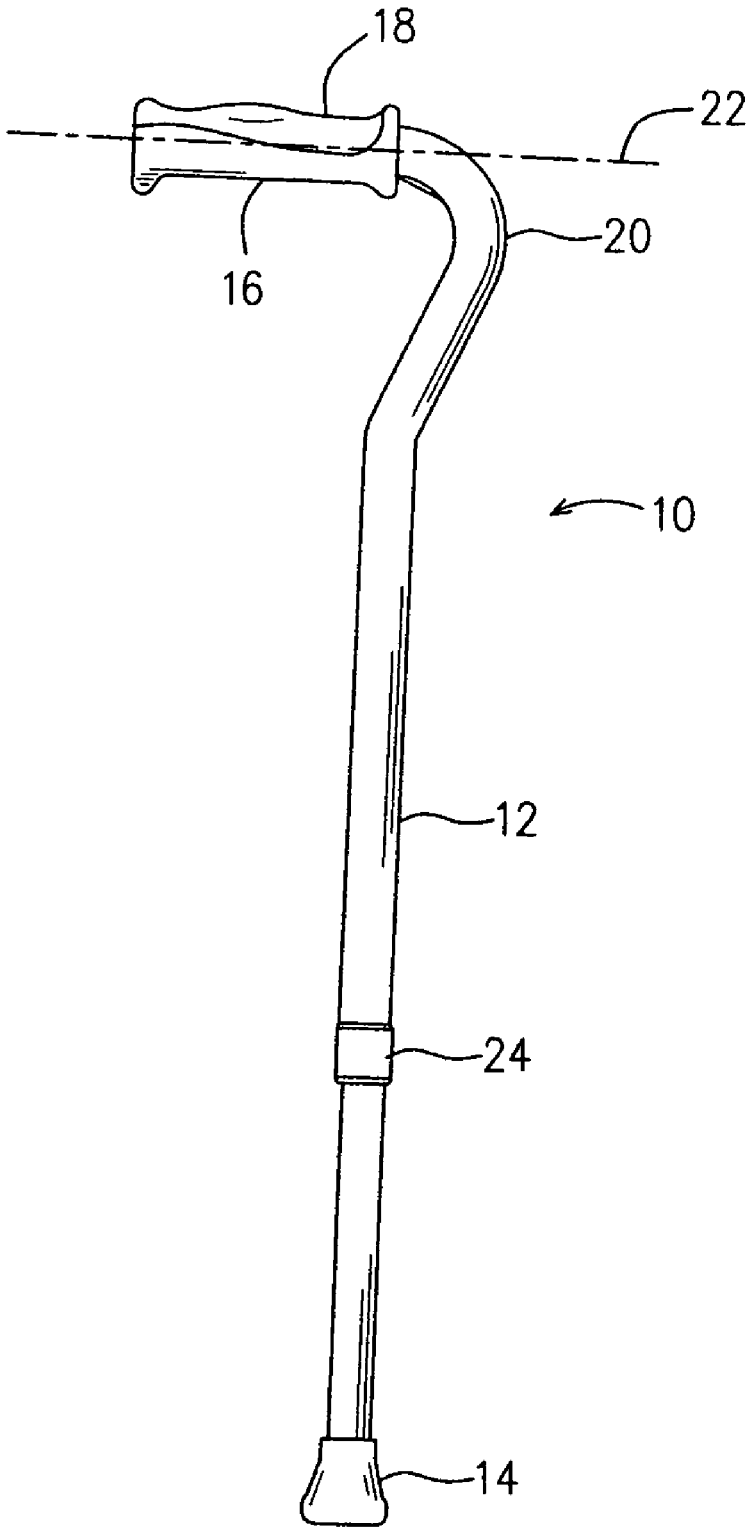
FIG. 1 is a side elevational view of a cane incorporating one embodiment of the present invention.

Referring to FIG. 1, a cane according to one embodiment of the present invention is generally indicated by numeral 10. The cane 10 generally includes a cane shaft 12 having an upper end (not indicated) and a lower end (not indicated) thereof. A cane tip 14 of soft and resilient material such as rubber or other resiliently deformable plastic or elastomer is preferably attached to the lower end of the cane shaft 12. A two-piece handle 16 is affixed to the upper end of the cane shaft 12 to define a hand grip 18 to be grasped reliably and comfortably by a user's hand when the cane 10 is in use. An axis of the hand grip 18 is indicated by numeral 22. An upper section 20 of the cane shaft 12 is bent in a desired angle, for example 90° or an angle slightly greater than 90° such that the axis 22 is oriented in such a desired angle with respect to the cane shaft 12.

The cane shaft 12 is preferably adjustable in length. For example, the cane shaft 12 can be of a telescoping configuration made of metal tubes. A split lock ring (not shown) may be retained in position by a threaded collar 24 to lock the telescoping configuration of the cane shaft 12 in a selected length. Preferably, a pin (not shown) and a plurality of positioning holes (not shown) may be provided to the telescoping configuration of the cane shaft 12 in combination with the lock collar 24, for locking the telescoping configuration of the cane shaft 12 in a selected length. All features of the telescoping configuration are well known in the prior art and will not be further described in detail.

Figure 2A:
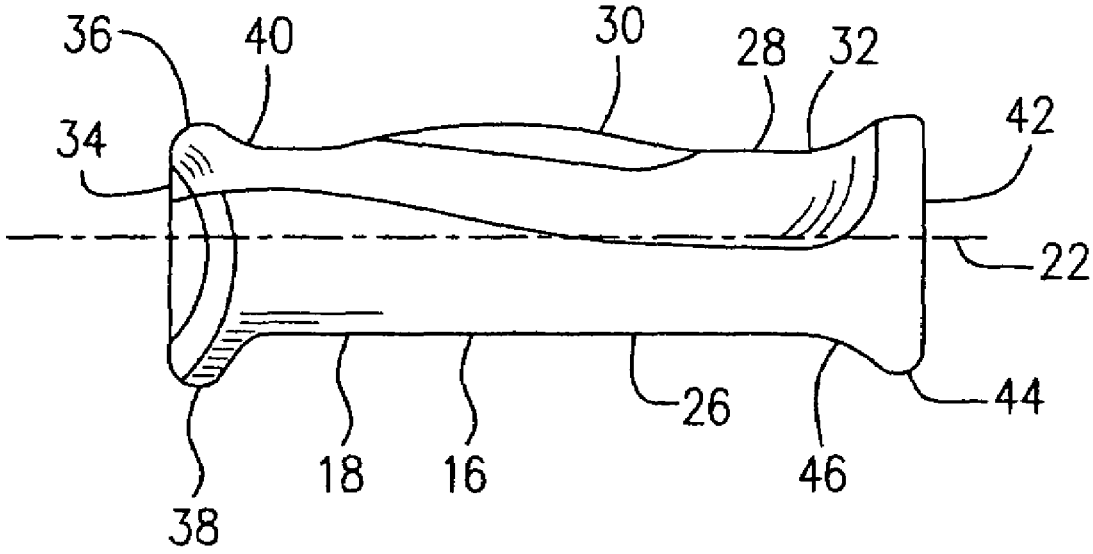
FIG. 2A is a side elevational view of a handle of the cane of FIG. 1, showing the two-piece configuration of the handle including a soft and resilient top portion attached to a rigid body portion thereof.
Figure 2B:
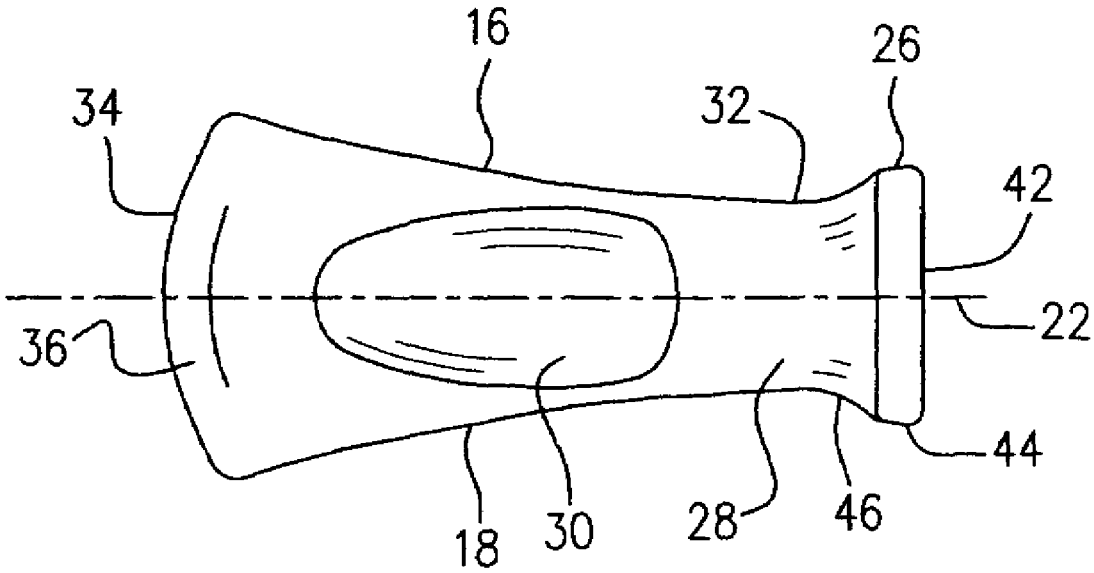
FIG. 2B is a top plane view of the handle of the cane of FIG. 1, showing the profile of the handle substantially defined by the rigid body portion thereof.
Figure 3A:
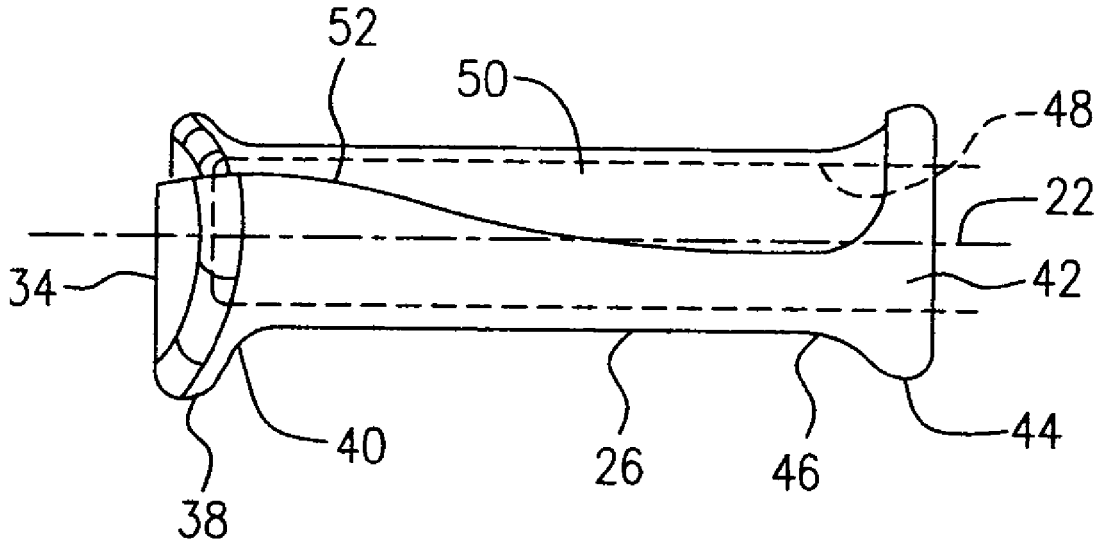
FIG. 3A is a side elevational view of the rigid body portion of the handle of FIG. 2A.
Figure 3B:
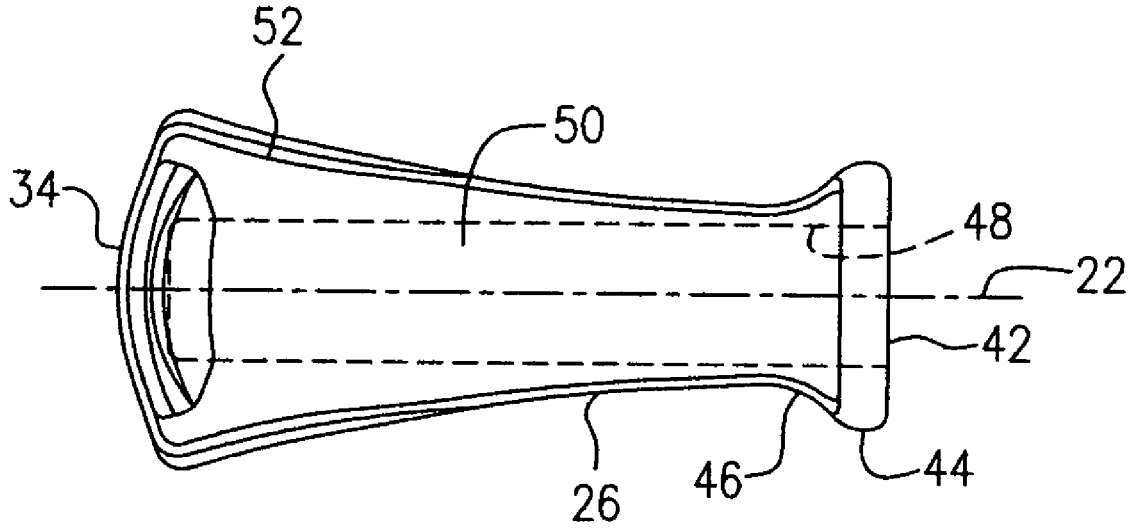
FIG. 3B is a top plane view of the rigid body portion shown in FIG. 3A.

Referring to FIGS. 2A-4B, the two-piece handle 16 includes a substantially rigid body portion 26 which substantially defines a profile of the handle 16 in a top view as shown in FIGS. 2B and 3B, and top portion 28 attached to the body portion 26. The rigid body portion 26 is preferably made of a plastic material in a molding process. The top portion 28 is soft and resilient with respect to the rigid body portion 26 and is preferably made of a suitable resilient and deformable plastic or elastomer in a molding process. However, the top and body portions 28, 26 can also be made in a double injection molding process in which two different molding materials are injected into different cavities of a mold of the handle in different injection steps.

The top and body portions 28, 26 of the handle 16 in combination define the hand grip 18. An upward projection 30 extends from the top portion 28 in a middle location thereof. The handle 16 increases in width from a front section 32 of the handle 16 towards a rear end 34 thereof which projects rearwardly to form a convex shape. The handle 16 includes a shoulder 36 at the convex rear end 34 extending upwardly from the top portion 28, and a heel 38 of the convex rear end 34 extending downwardly from the body portion 26. A curved transitional surface 40 extends around the handle 16 at the rear end 34 thereof to smoothly connect both the upward shoulder 36 and the downward heel 38 to the hand grip 18 of the handle 16.

The handle 16 further includes a front end 42 formed by a front end section of the rigid body portion 26 forming a radially protruding annular ridge 44. A curved transitional surface 46 extends around the handle 16 at the front end 42 to smoothly connect the radially protruding annular ridge 44 with the hand grip 18. The hand grip 18 is thus defined between the radially protruding annular ridge 44 at the front end 42 of the handle 16 and the upward shoulder 36 and downward heel 38 at the rear end 34 of the handle 16, and is sized in a substantially unchanged dimension in the side view of FIG. 2A except for the upward projection 30 in the middle thereof.

A hole 48 (illustrated by broken lines in FIGS. 3A and 3B) is defined in the front end 42 of the handle 16 formed by the body portion 26, and extends into the body portion 26 substantially along the axis 22 of the hand grip in order to engage the upper end of the cane shaft 12 of FIG. 1 therein such that the cane shaft 12 is oriented in the desired angle with respect to the axis 22 of the hand grip 18.

The top and body portions 28, 26 of the handle 16 are made in a double injection molding process of in separate molding processes but are configured such that the top portion 28 forms a top layer of the handle 16 as if the top layer of the handle 16 was pealed away to leave a cut off area generally indicated by numeral 50, thereby forming the body portion 26. The cut off area 50 is defined within a complete loop of a cutting edge 52 of the top of the body portion 26. The complete loop of the cutting edge 52 of the body portion 26 is configured and sized to exactly correspond with the peripheral edge 54 of the top portion 28 such that the peripheral edge 54 of the top portion 28 mates substantially seamlessly with the cutting edge 52 of the cut off area 50 of the body portion 26 when the top portion 28 is attached to the body portion 26.

It is just for convenience of description to describe the top and body portions 28, 26 as in a cutting off and peeling away manner. In fact, the top portion 28 is made of a soft and resilient material such as a resiliently deformable plastic or elastomer, and the body portion 26 is made of a rigid material such as polypropylene or other rigid plastic material. They are made in separate molding processes or in two steps of a double injection molding process.

The top portion 28 is preferably a thin layer except for the upward projection 30 such that the body portion 26 is provided with a cross-sectional dimension large enough to define the hole 48 therein. The upward projection 30 is preferably formed entirely by the top portion 28 to provide a suitable resiliency thereof in order to absorb an impact when transferring load from a user's hands therethrough to the cane shaft 12 and then to the ground.

Figure 4A:
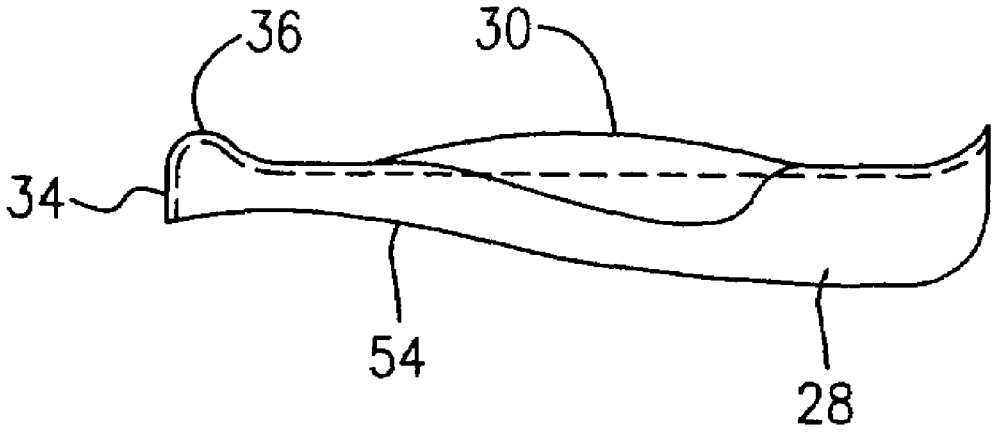
FIG. 4A is a side elevational view of the soft and resilient top portion of the handle of FIG. 2A.
Figure 4B:
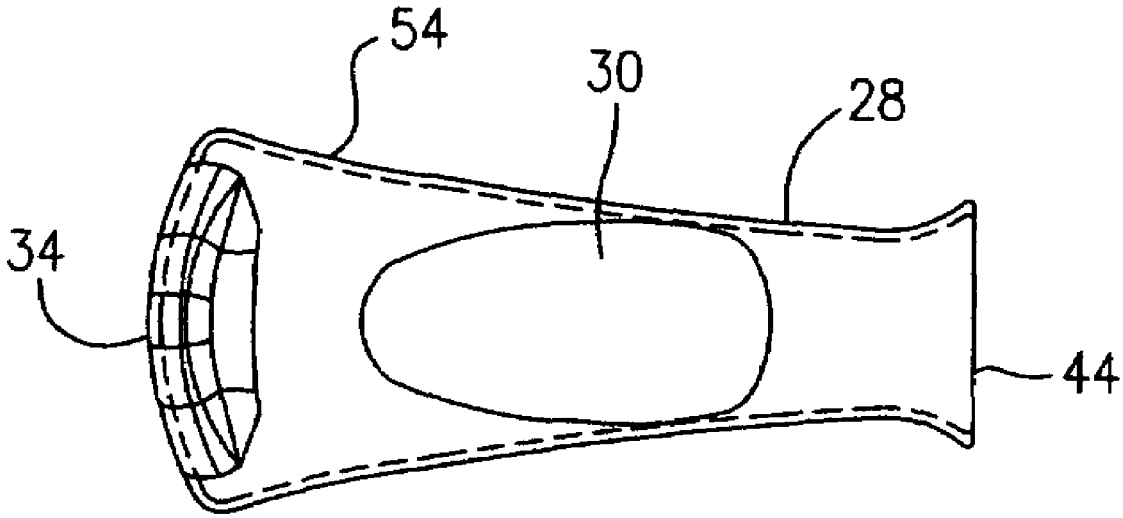
FIG. 4B is a top plane view of the top portion of FIG. 4A.
Figure 5A:
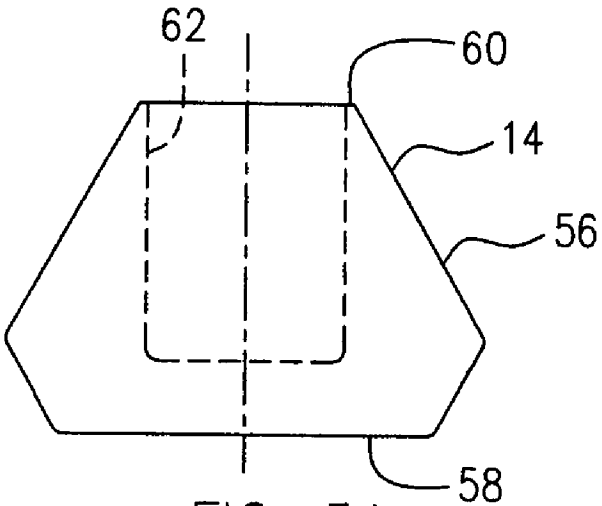
FIG. 5A is a side elevational view of a cane tip to be attached to a lower end of a cane shaft of the cane of FIG. 1, showing the tapering dimension from a bottom to a top of the tip.
Figure 5B:
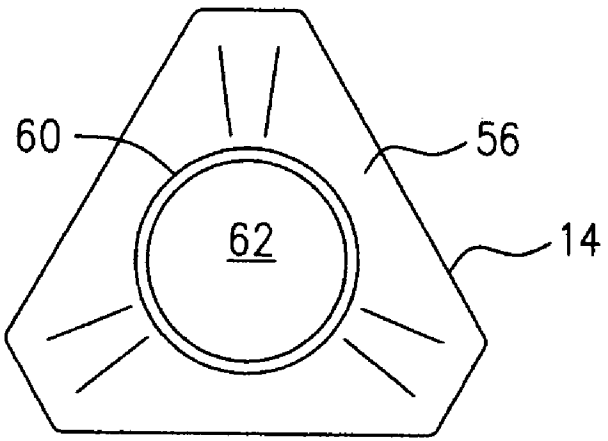
FIG. 5B is a top plane view of the cane tip of FIG. 5A, showing a round top and a triangular bottom thereof.
Figure 5C:
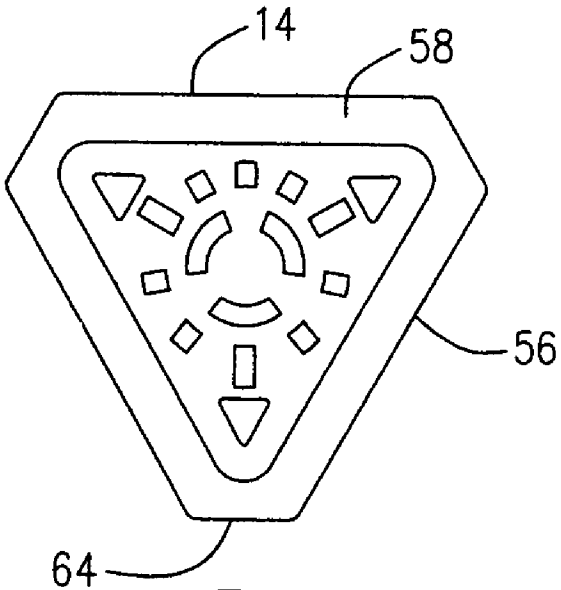
FIG. 5C is a bottom plane view of the cane tip of FIG. 5A, showing a tread design on the bottom surface thereof.

The configurations of the top and body portions 28, 26 in this embodiment are an example of the present invention and can be configured differently without departing from the spirit of the invention. For example, a rear end section (not indicated) of the top portion 28 may form the entire upward shoulder 36 similar to the upward projection 30, rather than being a thin layer as shown in FIG. 4A, with the body portion 26 having a configuration of the rear end section thereof (not indicated) to match such alternative configuration of the top portion 28. The radially protruding annular ridge 44, for example, may be formed by a combination of both top and body portions 28, 26, instead of being substantially formed by the body portion 26, as shown in FIG. 3A. The handle 16 of the present invention is configured to best fit into a user's hand when in use and thus provides a very comfortable hand grip 18. The rigid body portion 26 forms a major part of the configuration and thus provides a solid feeling when the user's hand grasps the hand grip 18. The soft and resilient top portion 28 gives the user a comfortable feeling and is enabled to absorb impact during load transfer from the user's hand through the cane shaft 12 into the ground. Furthermore, due to the properties of the soft and resilient material, the top portion 28 provides a surface having more frictional resistance than the surface of the body portion 26. This will further benefit the reliable grip because the surface of the top portion 28 is contacted by the palm of the user's hand during load transfer when the cane is in use.

Referring to FIGS. 1 and 5A-5C, the soft and resilient tip 14 attached to the lower end of the cane shaft 12 includes a body 56 preferably made of a resiliently deformable plastic, elastomer, rubber, etc. in a molding process. The body 56 of the tip 14 has a substantially triangular bottom 58 and tapers from the substantially triangular bottom 58 towards a top 60 thereof, gradually tapering into a substantially round shape at the top 60. The body 56 defines a hole 62 in the round top 60 thereof, extending into the body 56 for engagement with the lower end of the cane shaft 12. The bottom 58 has a tread design (not indicated) for increasing traction on the ground. Each corner 64 of the triangular bottom 58 is preferably beveled. Such resiliently deformable properties of the tip 14 together with such a configuration thereof, provides a secure contact with the ground even when the cane 10 is in a tilting orientation during the user's walk. A side of the triangular bottom 58 in contact with the ground will greatly increase the contact surface of the tip when the cane 10 is in a tilting orientation, in contrast to the contact surface of a round bottomed tip in a similar condition. Furthermore, the side of the triangular bottom 58 in contact with the ground when pressed onto the ground, will be deformed to increase the contact area between the tip 14 and the ground. When a corner of the triangular bottom 58 in contact with the ground is pressed onto the ground, the beveled configuration of the corner 64 and the resiliently deformable property thereof also make a secure contact between the tip and the ground.

Figure 6:
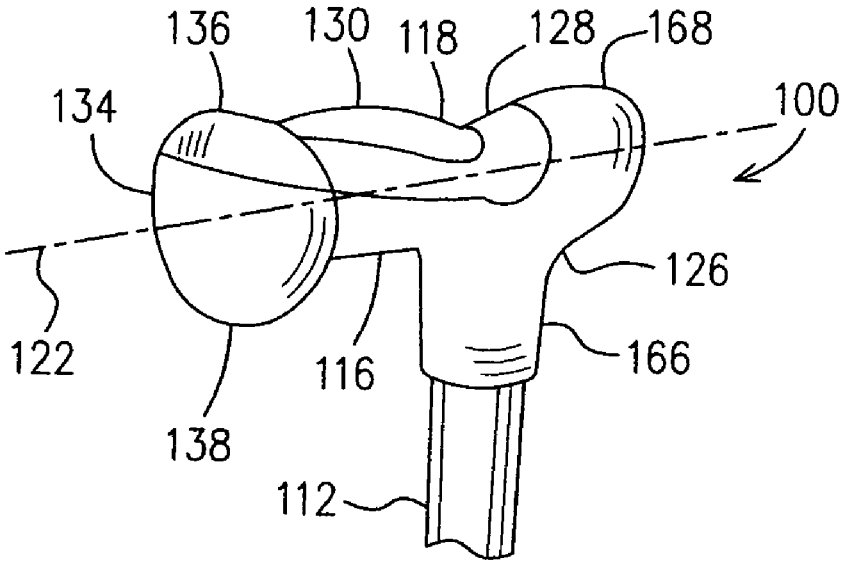
FIG. 6 is a partial perspective view of a cane according to another embodiment of the present invention, showing a two-piece handle similar to that of the cane in FIG. 1, but configured in a T-shape for connection with a straight cane shaft thereof.
Figure 7A:
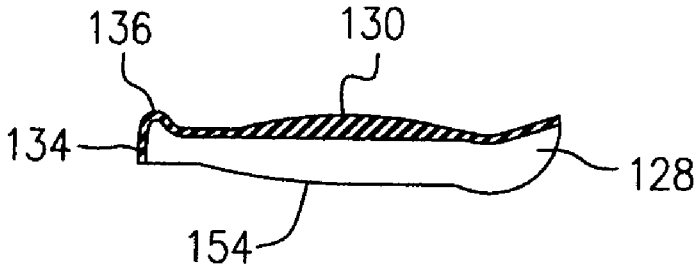
FIG. 7A is a cross-sectional view of a top portion of the handle used in the cane of FIG. 6.
Figure 7B:
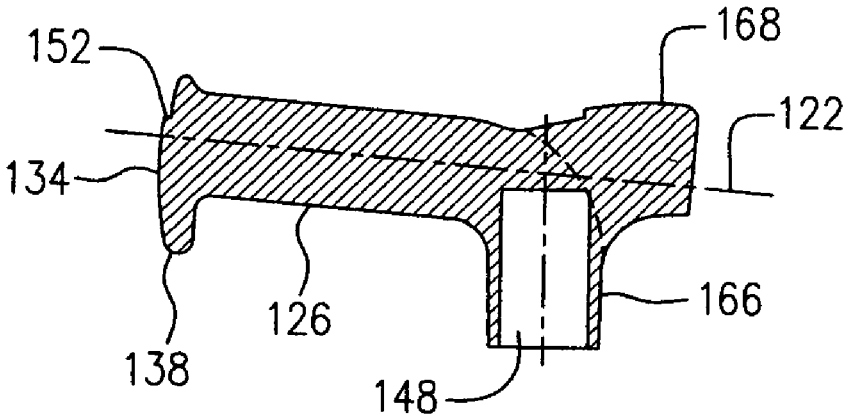
FIG. 7B is a cross-sectional view of the body portion of the handle used in the can of FIG. 6.

FIGS. 6 and 7A-7B illustrate another embodiment of the present invention in which a cane 100 is partially shown and includes a cane shaft 112 and a handle 116. The cane 100 has a similar configuration to that of cane 10 illustrated in FIGS. 1-5C. Similar components and features of cane 100 are indicated by numerals in the 100 series with the last two digits similar to those indicating similar components and features to those of cane 10, and will not be redundantly described. The difference between cane 100 and cane 10 of FIG. 1 lies in that the cane shaft 112 is straight and does not include a bent upper section. The upper end (not indicated) of the cane shaft 112 is oriented upwardly when the cane shaft 112 is in a vertical position. The handle 116 therefore must accordingly define a hole 148 to engage the upwardly extending upper end of the cane shaft 112 in order to maintain a desired angle between the cane shaft 112 and the axis 122 of the hand grip 118.

The handle 116 includes a downward section 166 preferably in a cylindrical configuration, formed by the body portion 126, extending downwardly in a desired angle with respect to the axis 122 of the hand grip 118. The hole 148 is defined in an end of the downward section 166 and extends thereinto for engagement with the upper end of the cane shaft 112.

The handle 116 further includes a front section 168 substantially formed by the body portion 126. The downward section 166 of the handle is located between the front section 168 and the hand grip 118.

The shaft 112 may be similar to the cane shaft 12 of cane 10 in FIG. 1, having a metal telescoping configuration for adjustment in length. However, the cane shaft 112 can also be a single stick of wood, plastic, metal tube, etc. with or without a tip attached to a lower end thereof.

The above description is meant to be exemplary only, and one skilled in the art will recognize that changes maybe made to the embodiments described without departure from the scope of the invention disclosed. For example, the cane of the present invention may include a cane shaft configured differently from the cane shafts described in the above embodiments but with a two-piece handle for the described functions. The two-piece handle of the present invention may also be configured differently from the exemplary configurations described in the embodiments. Still other modifications which fall within the scope of the present invention will be apparent to those skilled in the art in light of a review of this disclosure, and such modifications are intended to fall within the appended claims.

We claim:

1. A cane comprising a cane shaft having an upper end and a lower end thereof; and a two-piece handle affixed to the upper end of the cane shaft, the handle including a rigid body portion defining a low gripping surface of the handle, and a top portion attached to the body portion, the top portion being of soft and resilient material with respect to the body portion, thereby forming a hand grip having soft and resilient top and rigid bottom sides opposite to each other, the soft and resilient top portion in a longitudinal cross-sectional view of said top portion, having a middle area thicker than an area around the middle area to form an upward projection of the soft and resilient material extending from the top side, in order to allow impact absorption and solid gripping when a user's hand grasps the top and bottom sides of the hand grip, whereby the top portion mates substantially seamlessly with a cut off area of the body portion.

2. The cane as defined in claim 1 wherein the handle in a top view thereof comprises an increasing width from a front section of the handle towards a rear end of the handle.

3. The cane as defined in claim 2 wherein the handle comprises an upstanding shoulder at the rear end extending upwardly from the top portion of the handle and a heel at the rear end extending downwardly from the body portion of the handle.

4. The cane as defined in claim 1 wherein the top portion comprises a surface having more frictional resistance than a surface of the body portion.

5. The cane as defined in claim 1 wherein the body portion defines a hole therein, the upper end of the cane shaft being engaged in the hole such that the cane shaft is oriented in a desired angle with respect to an axis of the hand grip.

6. The cane as defined in claim 5 wherein the hole is defined in a front end of the handle formed by the body portion, the hole extending into the body portion substantially along the axis of the hand grip while an upper section of the cane shaft is bent to provide the desired angle between the upper end and the lower end of the cane shaft.

7. The cane as defined in claim 6 wherein the front end of the handle is formed by an end section of the body portion including a radially protruding annular ridge.

8. The cane as defined in claim 5 wherein the handle comprises a downward section formed by the body portion, the downward section extending downwardly in the desired angle with respect to an axis of the hand grip, the hole being defined in an end of the downward section and extending thereinto for engagement with the upper end of the cane shaft.

9. The cane as defined in claim 8 wherein the handle comprises a front section substantially formed by the body portion, the downward section of the handle being located between the front section and the hand grip.

10. The cane as defined in claim 1 wherein the cane shaft is adjustable in length.

11. The cane as defined in claim 1 comprising a tip of soft and resilient material attached to the lower end of the cane shaft.

12. The cane as defined in claim 11 wherein the tip comprises a body defining a hole in a top thereof for engagement with the lower end of the cane shaft and having a substantially triangular bottom thereof, the body tapering from the substantially triangular bottom towards the top and changing into a substantially round shape at the top.

13. The cane as defined in claim 12 wherein the bottom of the tip comprises a tread design.

14. The cane as defined in claim 12 wherein at least one corner of the substantially triangular bottom of the tip is beveled.

* * * * *